US009999310B2

(12) United States Patent
Brown

(10) Patent No.: US 9,999,310 B2
(45) Date of Patent: Jun. 19, 2018

(54) HANGER SYSTEM, METHOD AND APPARATUS

(71) Applicant: Todd Brown, Lisle, IL (US)

(72) Inventor: Todd Brown, Lisle, IL (US)

( * ) Notice: Subject to any disclaimer, the term of this patent is extended or adjusted under 35 U.S.C. 154(b) by 0 days. days.

(21) Appl. No.: 15/216,882

(22) Filed: Jul. 22, 2016

(65) Prior Publication Data

US 2018/0020857 A1 Jan. 25, 2018

(51) Int. Cl.
*A41D 27/22* (2006.01)
*A47G 25/14* (2006.01)

(52) U.S. Cl.
CPC ..... *A47G 25/14* (2013.01)

(58) Field of Classification Search
CPC ..... A47G 25/14; A47G 25/16; A47G 25/28; A47G 25/30; A47G 25/40; A47G 25/4076
See application file for complete search history.

(56) References Cited

U.S. PATENT DOCUMENTS 1,009,522 A * 11/1911 Hunter ..... A47G 25/32 223/90
1,014,976 A * 1/1912 Rein ..... A47G 25/486 223/93
1,716,985 A * 6/1929 Spear ..... A47G 25/486 223/93
1,991,987 A * 2/1935 Smith ..... A47G 25/52 223/91
2,591,169 A * 4/1952 Levine ..... D06F 55/00 211/119.12
2,723,064 A * 11/1955 Richards ..... A47G 25/485 223/91
3,967,766 A * 7/1976 Hart ..... A47G 25/487 211/113
5,975,384 A * 11/1999 Manabat ..... A47G 25/485 223/91
2004/0084487 A1* 5/2004 Keating ..... A47G 25/486 223/93

* cited by examiner

*Primary Examiner* — Nathan Durham
(74) *Attorney, Agent, or Firm* — Nyman IP LLC; Scott Nyman

(57) ABSTRACT

A hanging system is disclosed. The hanging system is especially adapted to couple with travel bags of various sizes for holding garments and accessories in place when traveling or commuting. A second embodiment includes a hangar accessory which allows the hanging system to be mounted from a standard hanging rod.

8 Claims, 5 Drawing Sheets

Fig. 1
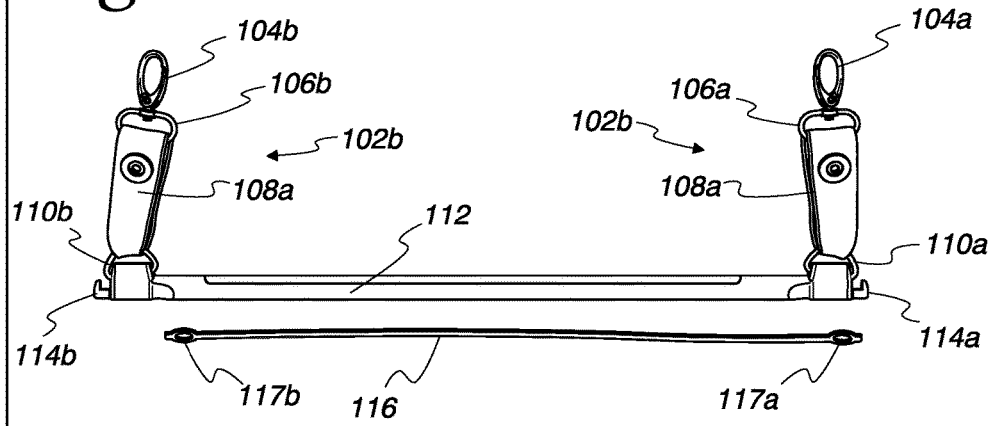
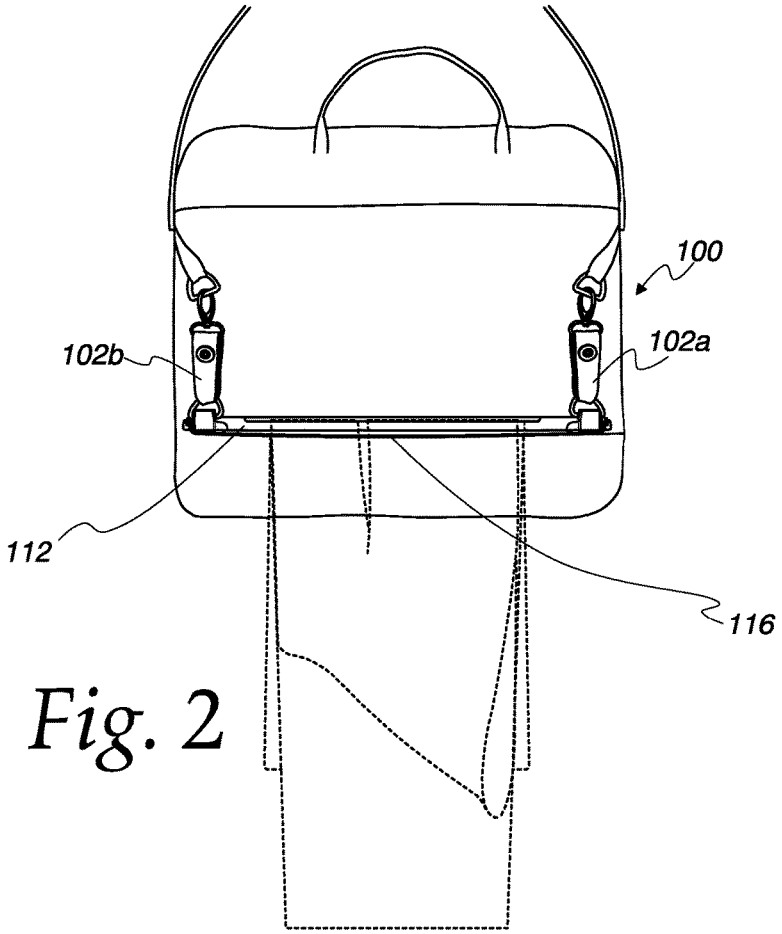
Fig. 2

HANGER SYSTEM, METHOD AND APPARATUS

FIELD OF THE DISCLOSURE

The present disclosure generally relates to a system, method and apparatus for hanging clothing, as well as umbrellas and other garments and accessories. More particularly, the present disclosure relates to a flexible hanger apparatus and system for hanging clothing, garments, and accessories wherein the apparatus and system can be mounted to hand bags, messenger bags, and other travel bags, as well as methods for use thereof.

BACKGROUND

Conventional clothing hangers typically comprise a rigid structure having a hook for attachment to a hanging rod. The rigid structure generally comprises a pair of downward angled upper members extending in opposite directions from base of the hook. In addition, many hangers have an additional transverse lower member extending between the upper members. The rigid structure and hook may be formed of a single wire or piece of molded plastic, or the rigid structure may be formed of plastic or wood with the hook mounted thereto.

Generally, the shoulders of a garment, such as a shirt or jacket, can be draped over the upper members of the hanger to maintain the garment in an upright orientation without wrinkling or creasing the garment. When the lower transverse element is present, additional garments, such as pants or trousers may be draped over the lower transverse element to similarly reduce the risk of wrinkling or creasing the garment.

However, typical hangers are inconvenient for use by travelers or commuters. In particular, travelers and commuters generally must use garment bags to maintain clothing in wrinkle free condition while traveling. However, space is at a premium when traveling or commuting, and carrying an additional garment bag is both inconvenient and potentially costly. Accordingly, a need exists for an apparatus and system for hanging garments and accessories that can be easily used with a handbag, messenger bag, or other small travel bag.

OBJECTS OF THE DISCLOSED SYSTEM, METHOD, AND APPARATUS

Accordingly, it is an object of this disclosure to provide a system and apparatus for hanging garments and accessories that can be attached to a handbag, messenger bag, or other small travel bag.

Another object of the disclosure is to provide a flexible system and apparatus for hanging garments and accessories that can be easily transferred from a travel bag to a hanging rod.

Another object of the disclosure is to provide a method for the use of the flexible system and apparatus disclosed herein.

Other advantages of this disclosure will be clear to a person of ordinary skill in the art. It should be understood, however, that a system or method could practice the disclosure while not achieving all of the enumerated advantages, and that the protected disclosure is defined by the claims.

SUMMARY OF THE DISCLOSURE

A hanging apparatus and system for use by travelers and commuters is disclosed. In a first embodiment, the hanging system comprises a transverse element on which trousers, pants and slacks can be draped. The transverse element is coupled to a right clasping strap by a first right mounting ring. The right clasping strap is also coupled to a right spring loaded hook by a second right mounting ring. The transverse element is also coupled to a left clasping strap by a first left mounting ring. The left clasping strap is also coupled to a left spring loaded hook by a second left mounting ring.

The hanging system further comprises a left and right mounting tab, each integrally formed to the transverse element. The mounting tabs can be used to hold a clothing strap in place using a pair of eyelets; one on each end of the clothing strap.

In an additional embodiment the hanger system further comprises a hanging accessory, that includes right and left angular elements. The angular elements each include an additional mounting ring adapted to couple with the corresponding spring loaded hooks. In addition, a hook is disposed between the angular elements, so that the hanging system can be hung from a standard clothing rod.

It should be noted that in an additional embodiment of the disclosure the right and left clasping straps can be adjustable, so that a variety of bags can be accommodated.

BRIEF DESCRIPTION OF THE DRAWINGS

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 1 depicts an embodiment of the flexible hanger system and apparatus disclosed herein;

FIG. 2 depicts the disclosed flexible hanger system and apparatus holding garments and accessories while attached to a travel bag;

DETAILED DESCRIPTION

Figure 3:
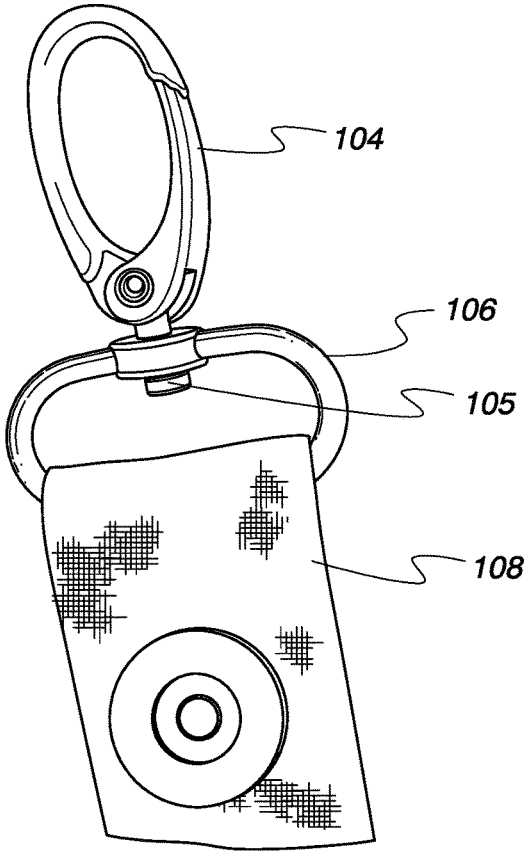
FIG. 3 depicts a close up view of a strap and hook mounting mechanism for use with the flexible hanger system and apparatus disclosed herein.

Turning to the Figures and to FIG. 1 in particular, an embodiment of the disclosed flexible hanger system and apparatus is illustrated. As illustrated, the flexible hanger system and apparatus comprises left and right clasping straps 102*a*, 102*b*. The clasping straps 102*a*,102*b* can be made of, for example, ballistic nylon, although another material, such as vinyl, bamboo, or various metals, could be used. Each clasping strap 102*a,b* comprises a spring loaded hook 104*a,b*, which allows the clasping strap 102 to be connected to a travel bag as discussed herein. Each clasping strap 102*a,b* further comprises a mounting ring 106*a,b*, which mounts the spring loaded hook 104*a,b* to a strap 108*a,b*. The mounting rings 106*a,b* could be made of any reasonable material, such as aluminum, stainless steel, plastic, etc. While the clasping straps 102*a,b* are drawn as being coupled to mounting rights using spring loaded hooks 104*a, b*, a variety of other mechanisms could be used, such as, for example, buttons, hook and loop fasteners, simple ties, etc.

Each strap 108*a,b* is mounted to a transverse element 112 by a mounting ring 110*a,b*. Integrally formed to each end of the transverse element 112 is a mounting tab 114*a,b*. As discussed herein, the mounting tab 114*a,b* can hold a clothing strap 116 in place, which can be used to, for example, hold a pair of trousers or pants in place. As depicted the clothing strap includes a right eyelet 117*b* and a left eyelet 117*a*. The left and right clasping straps 102*a*,102*b* can be adjustable to accommodate a variety of bags. The surface of the transverse element 112 can also be covered with a non-slip surface such as, for example, matted rubber.

Turning to FIG. 2, the hanging apparatus and system 100 of the present disclosure is illustrated. In particular, the hanging apparatus 100 is depicted with a jacket draped over the clasping straps 102*a,b*, and a pair of slacks draped over the transverse element 112. The clothing strap 116 holds the slacks and jacket in place, and supports them in a substantially wrinkle and crease free state.

Turning to FIG. 3, a close up view of the strap and hook mounting mechanism utilized by the present disclosure is depicted. As depicted the strap and hook mounting mechanism comprises a spring loaded hook 104, which is adapted to couple to various mounting rings on travel bags (not shown). The spring loaded hook 104 is coupled to a mounting ring 106. As shown, the spring loaded hook 104 is depicted as coupled to the mounted tab 106 using a swivel screw 105. The mounting ring 106 is coupled to a strap 108. As depicted, the strap 108 is shown as made from ballistic nylon. However, this is strictly for demonstrative purposes, rather than for purposes of limitation.

Figure 4:
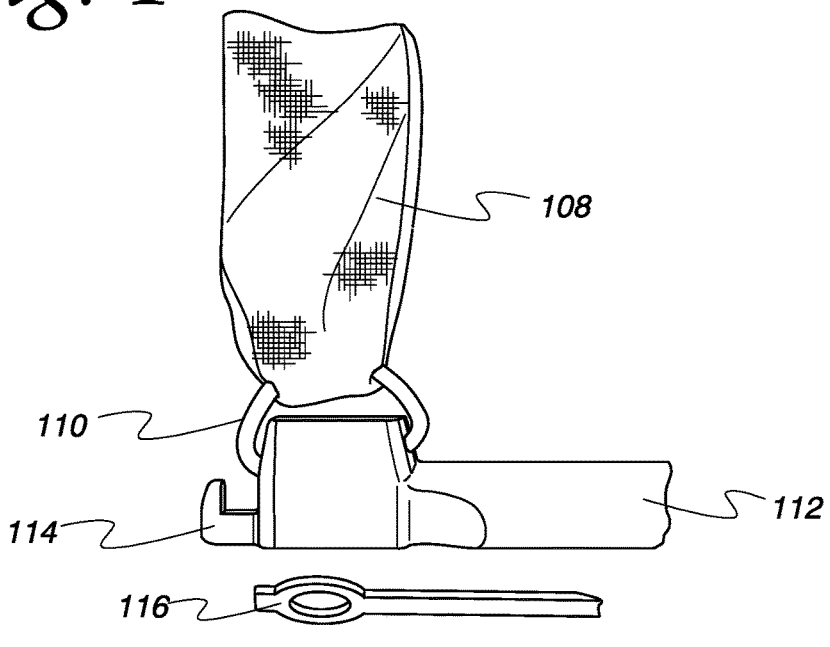
FIG. 4 depicts a close up view of a strap mounting mechanism for use with the flexible hanger system and apparatus disclosed herein.

Turning to FIG. 4, a close up view of the strap 108 as coupled to the transverse element 112 is depicted. In particular, the transverse element 112 is coupled to the strap 108 using a mounting ring 110. Also depicted is a mounting tab 114, which as discussed herein, is used to hold a clothing strap 116 in place.

Figure 5:
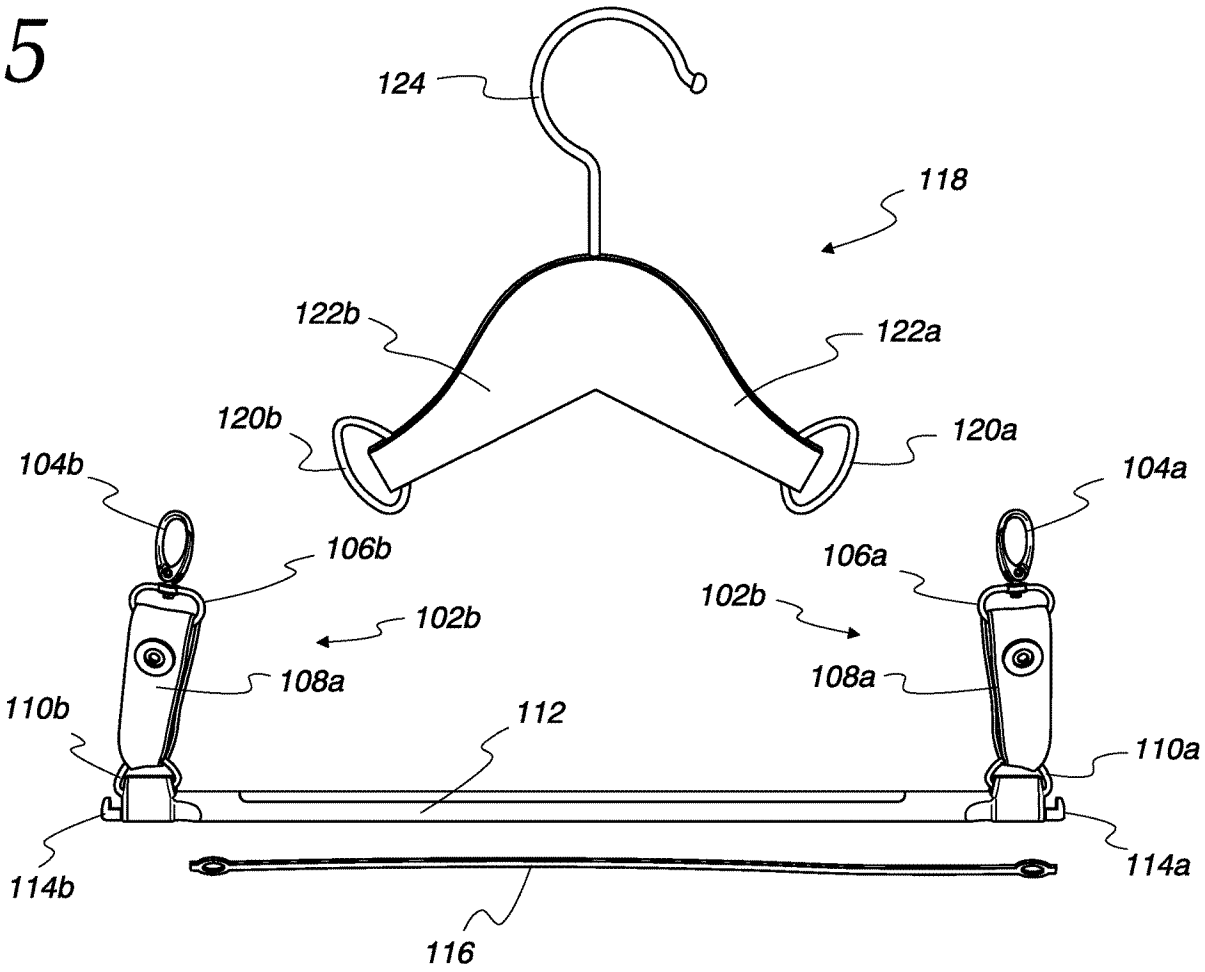
FIG. 5 depicts an additional embodiment of the flexible hanger system and apparatus disclosed herein including a clothing rod hanging mechanism.

Turning to FIG. 5, a second embodiment of the disclosed hanging embodiment and system is disclosed. This embodiment includes the entire embodiment of FIG. 1. In particular, as illustrated, the flexible hanger system and apparatus comprises left and right clasping straps 102*a*, 102*b*. Each clasping strap 102*a,b* comprises a spring loaded hook 104*a, b*, which is adapted to couple with the hanging accessory 118 as discussed below. Each clasping strap 102*a,b* further comprises a mounting ring 106*a,b*, which mounts the spring loaded hook 104*a,b* to a strap 108*a,b*. Each strap 108*a,b* is mounted to a transverse element 112 by a mounting ring 110*a,b*. Integrally formed to each end of the transverse element 112 is a mounting tab 114*a,b*. As discussed herein, the mounting ring 114*a,b* can hold a clothing strap 116 in place, which can be used to, for example, hold a pair of trousers or pants in place.

The hanging accessory 118 comprises a right angular element 122*a* and a left angular element 122*b*. Both of the angular elements 122*a,b* are coupled to mounting rings 120*a,b*. The mounting rings are adapted to couple with the spring loaded hooks 104*a,b*. In addition, a hanging hook 124 is coupled to the angular elements. The hanging hook 124 allows the flexible hanger apparatus and system to be hung from a hanging rod as depicted in FIG. 6.

Figure 6:
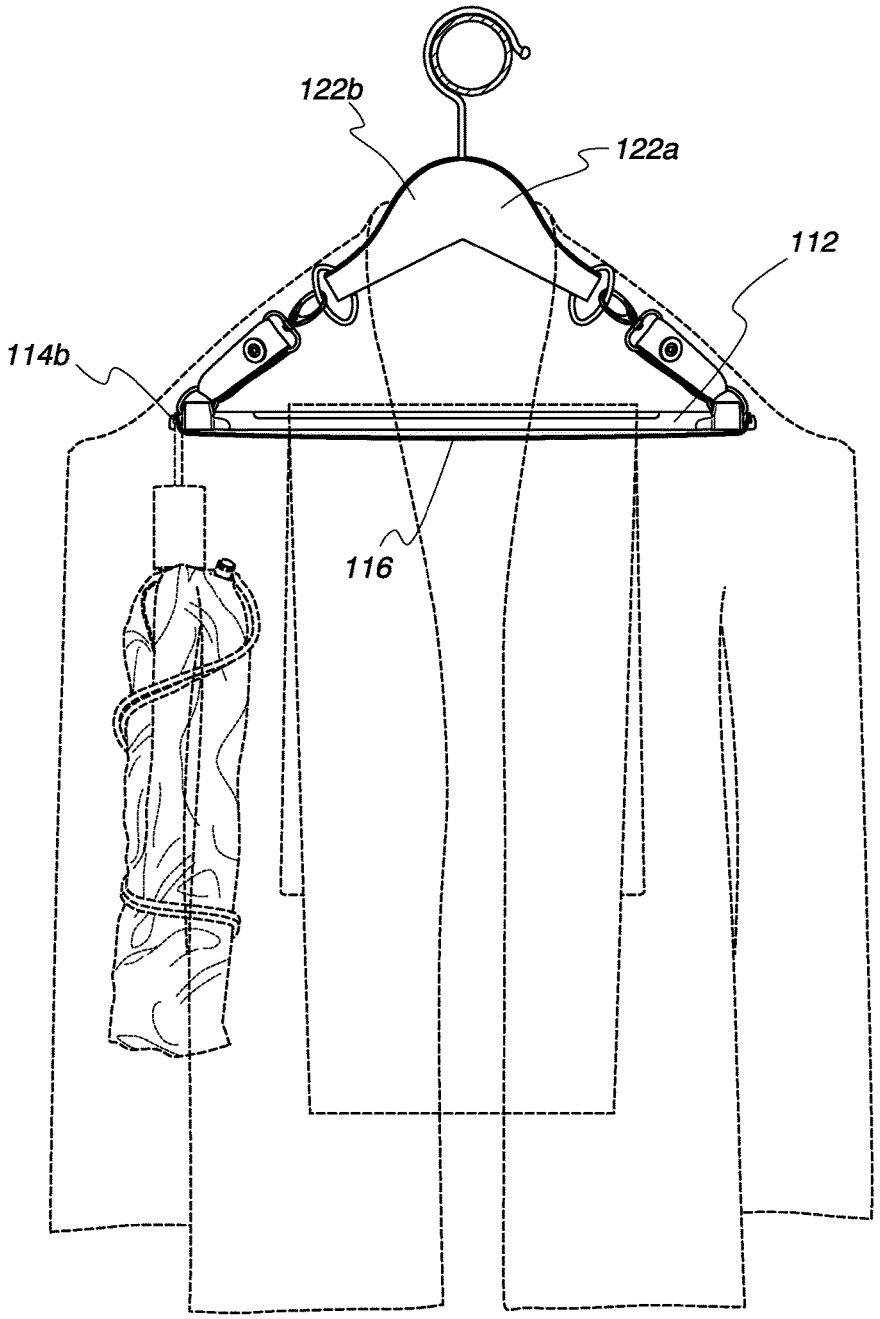
FIG. 6 depicts the embodiment of FIG. 5 holding garments and accessories while hanging from a hanging rod.

FIG. 6 depicts the second embodiment of the flexible hanger apparatus and system hanging from a hanging rod, as is typically present in, for example, a hotel room, airport lounge, train lounge, or other travel destination. The flexible hanger apparatus and system is also depicted with a jacket draped over the angular elements 122*a,b*, a pair of slacks draped over the transverse element 112, with the clothing strap 116 holding the slacks in place, and an umbrella also hanging from one of the mounting tabs 114*b*.

Figure 7:
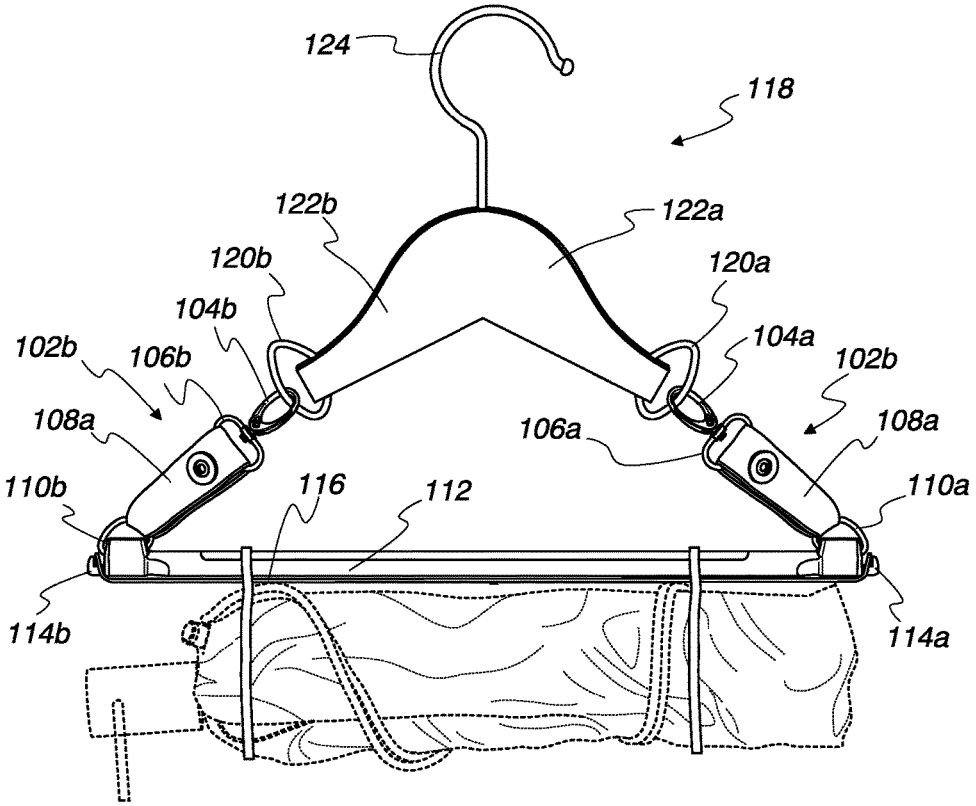
FIG. 7 depicts the embodiment of FIG. 5 with a mounting mechanism coupled to the transverse element that could be used to, for example, hang an umbrella or other accessory.

FIG. 7 depicts an additional refinement of the hanging system. This embodiment is identical to that of FIGS. 5 and 6, but includes a pair of straps coupled to the transverse element that can be used by users to, for example, hang an umbrella or other accessory.

The foregoing description of the disclosure has been presented for purposes of illustration and description, and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It is intended that the scope of the disclosure not be limited by the specification, but be defined by the claims set forth below. In addition, although narrow claims may be presented below, it should be recognized that the scope of this invention is much broader than presented by the claim(s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. A hanging system comprising:

a) a hanging accessory comprising:
  i) a hanging accessory body comprising:
    1) an upper hanging accessory element,
    2) a right hanging accessory element extending outwardly in an approximately right direction from the upper hanging accessory element, and
    3) a left hanging accessory element extending outwardly in an approximately left direction from the upper hanging accessory element,
  ii) a right hanging mounting ring directly attached to the right hanging accessory element and distal to upper hanging accessory element,
  iii) a left hanging mounting ring directly attached to the left hanging accessory element and distal to upper hanging accessory element, and
  iv) a hanging accessory hook extending outwardly in an upward direction from the hanging accessory body;

b) a transverse element;

c) a right clasping strap coupled to the transverse element;

c) a left clasping strap coupled to the transverse element;

d) a right mounting mechanism coupled to the right clasping strap and removably coupled to the right hanging mounting ring; and e) a left mounting mechanism coupled to the left clasping strap and removably coupled to the left hanging mounting ring.

2. The hanging system of claim 1:

wherein the right clasping strap is coupled to the transverse element by a first right mounting ring, and wherein the left clasping strap is coupled to the transverse element by a first left mounting ring.

3. The hanging system of claim 1:

wherein the right clasping strap is coupled to the right mounting mechanism by a second right mounting ring, and wherein the left clasping strap is coupled to the left mounting mechanism by a second left mounting ring.

4. The hanging system of claim 3:

wherein the right clasping strap is selectively supported via the right mounting mechanism by the right hanging mounting ring, and wherein the left clasping strap is selectively supported via the left mounting mechanism by the left hanging mounting ring.

5. The hanging system of claim 1, further comprising:

a right mounting tab integrally formed to the transverse element, and a left mounting tab integrally formed to the transverse element.

6. The hanging system of claim 5, further comprising:

a clothing strap comprising:

a right eyelet adapted to couple to the right mounting tab, and a left eyelet adapted to couple to the left mounting tab.

7. The hanging system of claim 1, wherein the hanging accessory hook comprises:

an arcuate hook portion by which of a hanging accessory weight of the hanging accessory is supportable.

8. The hanging system of claim 7:

wherein a combined weight of the transverse element and a garment is supportable by the hanging accessory via coupling of the right mounting mechanism with the right hanging mounting ring and the left mounting mechanism with the left hanging mounting ring.

* * * * *